US006505532B1

(12) United States Patent
Lawson

(10) Patent No.: US 6,505,532 B1
(45) Date of Patent: Jan. 14, 2003

(54) UNIVERSAL DRAIN TOOL

(75) Inventor: Thomas Michael Lawson, Albany, GA (US)

(73) Assignee: Lawson Industries, Albany, GA (US)

( * ) Notice: Subject to any disclaimer, the term of this patent is extended or adjusted under 35 U.S.C. 154(b) by 0 days.

(21) Appl. No.: 09/907,869

(22) Filed: Jul. 18, 2001

(51) Int. Cl.[7] ..... B25B 13/00
(52) U.S. Cl. ..... 81/124.3; 81/437
(58) Field of Search ..... 81/121.1, 124.3, 81/124.7, 437

(56) References Cited

U.S. PATENT DOCUMENTS 1,529,075 A * 3/1925 McIntyre ..... 81/124.3
1,870,612 A * 8/1932 De Schebeko ..... 81/124.3
4,562,758 A * 1/1986 Stirling ..... 81/124.7
5,259,281 A * 11/1993 Burke ..... 81/124.3
5,819,610 A * 10/1998 Brannan ..... 81/437
6,098,503 A * 8/2000 Hlinka ..... 81/124.3

* cited by examiner

*Primary Examiner*—Eileen P. Morgan
*Assistant Examiner*—Joni B. Danganan
(74) *Attorney, Agent, or Firm*—Thomas, Kayden, Horstemeyer & Risley, LLP

(57) ABSTRACT

A universal drain tool for use with shower and sink drains is provided. A representative drain tool includes a head containing a shaped aperture configured to engage the lock nuts of common shower and sink drains. The tool includes a handle attached to a head part. The handle allows the user to rotate the head part when the head part is engaged with the shower or sink drain. The head part can include an edge piece configured to insert into the internal lock nut slots of commonly available drop-in shower drains.

19 Claims, 3 Drawing Sheets

UNIVERSAL DRAIN TOOL

BACKGROUND OF THE INVENTION

1. Field of the Invention

The present invention relates to tools and, more particularly, to tools for use in installing and removing shower or sink drains.

2. Description of the Related Art

Many tools have been developed for use within the construction industry. Various general purpose tools are commonplace, such as hammers, saws, screwdrivers, wrenches, as well as other tools. Certain tools have been developed or refined for particular trades, and specialized tools facilitate efficient completion of the work required to be performed by various tradesmen. By way of example, plumbers typically possess various tools, such as a pipe wrench, pipe cutter, breaker bar, etc. Plumbers also typically use specialized tools that enable them to more efficiently complete certain tasks such as the installation of pipes.

Within the industry, there are various types of drains, for example, shower and sink drains, which are difficult to install and remove. Shower and sink drains come in a variety of shapes and designs. Many commonly available shower and sink drains have lock nuts on the portion of the drain underneath the shower or sink surface. The lock nuts are used to install and remove the drain. Commonly available lock nuts include hex nuts, as well as lock nuts that include tabs, generally 4, 6 or 8 tabs, in various configurations. Additionally drop-in shower drains are commonly known for use in stand-up showers. The drop-in shower drains typically are configured with lock nut slots accessible from the top of the drain (the portion inside the stand-up shower) so that the drain may be installed or removed from inside the shower.

Conventionally, in order to install the various drain types, a plumber or other contractor uses a screwdriver and a hammer for the tab style lock nuts, or a large pipe wrench for the hex nut-style lock nuts. Removal of a drain is often difficult, since use of the hammer and screwdriver can damage the tabs on the tab-style lock nuts, and use of the pipe wrench on the underside of a sink or shower for the hex nut style lock nuts is often cumbersome and difficult. Consequently, it is desirable to provide a tool for the removal and installation of common shower and sink drains.

Thus, a need exists in the industry to address the aforementioned and/or other deficiencies and inadequacies of the prior art.

SUMMARY OF THE INVENTION

The present invention provides a tool for installation and removal of common shower and sink drains. An embodiment of the tool includes a head part containing a shaped aperture configured to engage the lock nuts of various common shower and sink drains. The shaped aperture is configured to engage both hex nut, and at least one the commercially available tab nut style lock nut. In some embodiments, the tool includes a handle attached to a head part. The handle allows the user to rotate the head part when the head part is engaged with the shower or sink drain. The head part can include an edge piece configured to insert into the internal lock nut slots of the commonly available drop-in shower drains.

Other features and advantages of the present invention will become apparent to one with skill in the art upon examination of the following drawings, and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover in the drawings, like reference numerals designate corresponding parts throughout the several views.

DETAILED DESCRIPTION OF THE PREFERRED EMBODIMENT

Figure 1:
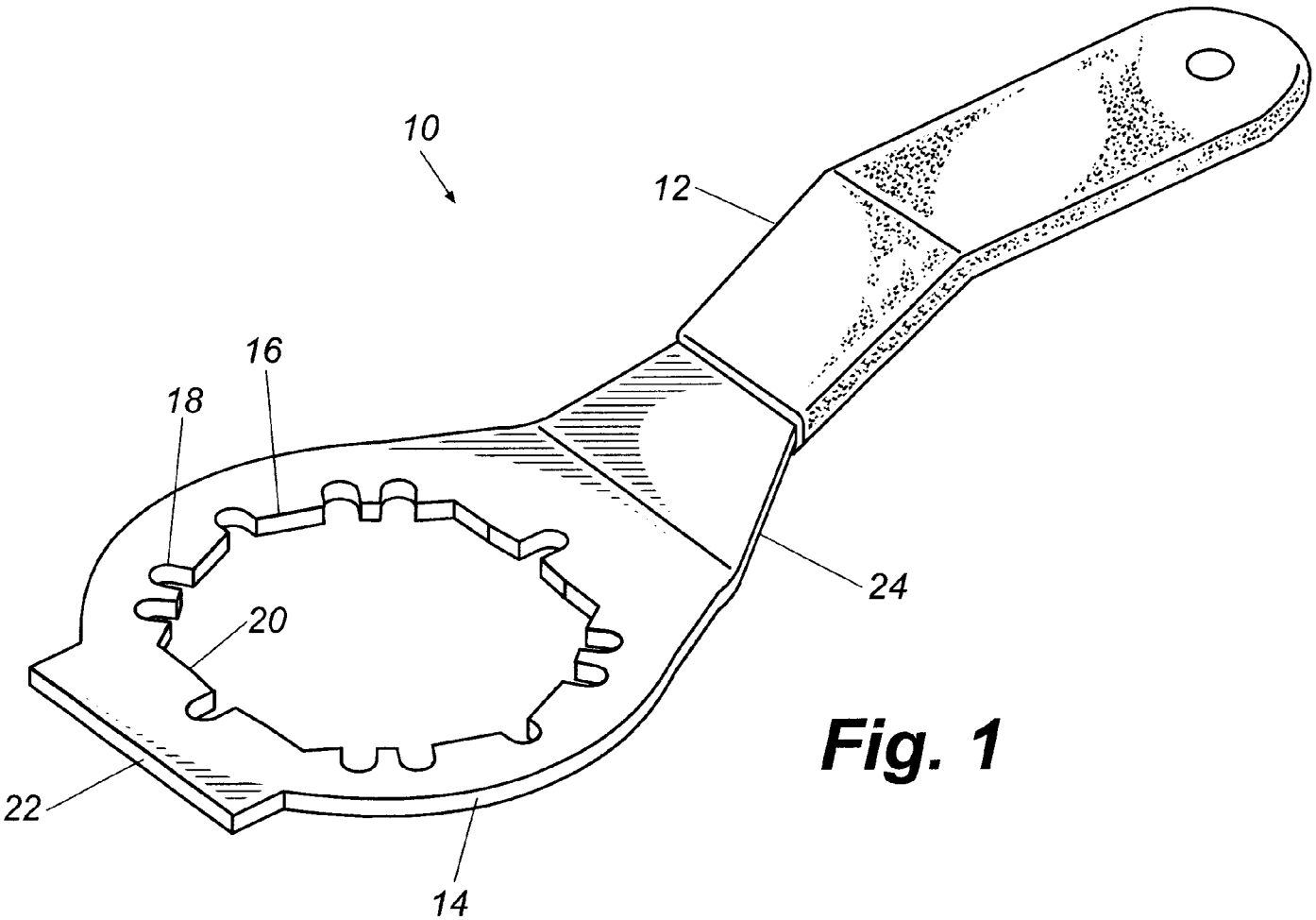
FIG. 1 is a perspective view of a representative embodiment of the present invention.

Referring now to the drawings, in which like numerals indicate corresponding parts throughout the several views, FIG. 1 is a perspective view of an embodiment of the present invention. As depicted in FIG. 1, the drain tool 10 comprises a head portion 14 that includes a shaped aperture 16. The shaped aperture 16 is configured to engage shower and/or sink drains that are commercially available. The shaped aperture 16 includes tab portions 18 designed to engage tab-type lock nuts on sink and/or shower drains. The number of tab slots 18 and the positioning of the tab slots 18 can vary. For example, in one embodiment, the tab slots 18 are configured to engage the tabs of 4 tab, 6 tab, and 8 tab locking nuts on conventional strainer drains.

Additionally, as depicted in FIG. 1, the shaped aperture 16 includes hex nut portions 20 designed to engage hex-type lock nuts on shower and/or sink drains. The shaped aperture 16 is also substantially symmetric and is of sufficient diameter to fit over standard strainer drains so that the shaped aperture 16 may engage the lock nuts of conventional sink and/or shower drains.

As shown in FIG. 1, in one implementation, the head portion 14 is substantially round. However, other shapes for the head portion are possible, including rectangular, square, triangular, etc. Such shapes are considered within the scope of the present invention. Also as depicted in FIG. 1, the drain tool 10 includes means for rotating the head portion 14 when the head portion 14 is engaged with the shower or sink drain. One implementation of the rotating means is an attached handle 12. Other rotating means such as a detachable handle (not shown) are equally applicable to the present invention and are considered within the scope of the present invention.

As further indicated in FIG. 1, the head portion 14 includes an edge piece 22 configured to engage internal lock nut slots of conventional drop-in shower drains. The edge piece 22 may be at the end of the head portion 14 opposite of the rotating means. In other embodiments, the edge piece 22 may be located at different places on the head portion 14 (not shown).

Figure 2:
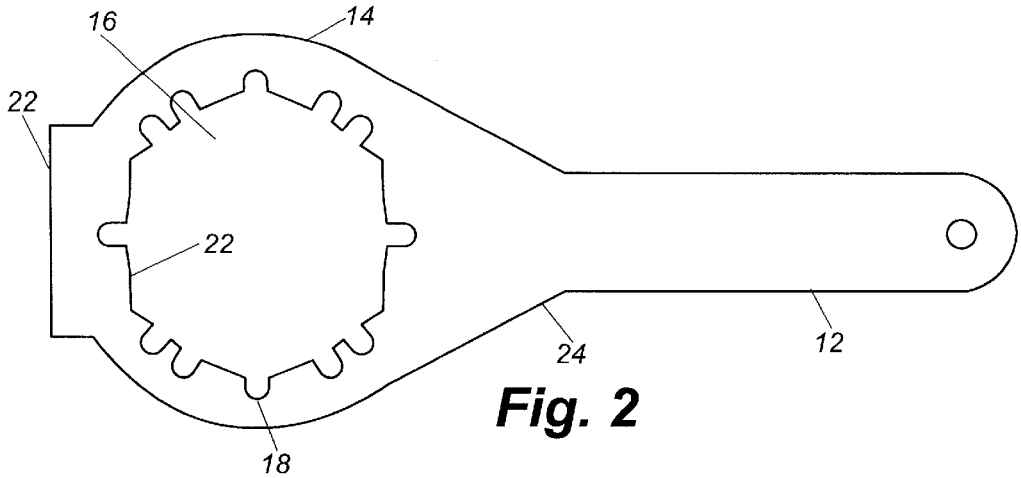
FIG. 2 is a top view of an embodiment of the present invention.
Figure 3:
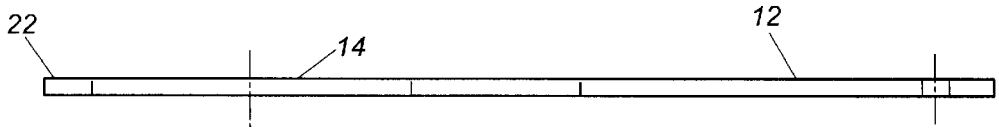
FIG. 3 is a side view of the embodiment depicted in FIG. 2.
Figure 6:
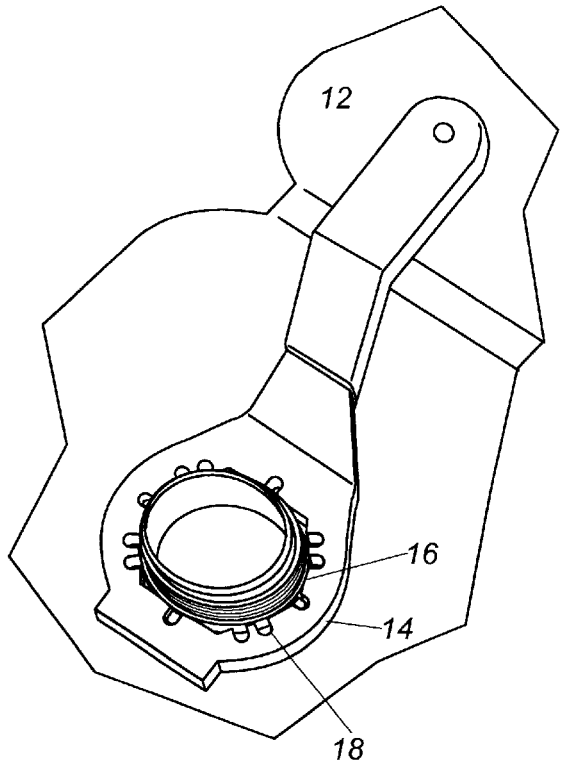
FIG. 6 is a top view of an embodiment of the invention engaged with an example tab-style shower drain.

FIG. 2 is a top view of one implementation of the present invention. As depicted in FIG. 2, the rotating means may be a fixed elongated handle 12, permanently attached to the head portion 14 such that the head portion 14 and handle 12 are substantially flat. In this embodiment, the handle 12 may be used to rotate the head portion 14 when the head portion 14 is engaged with the shower or sink drain. This is shown in FIG. 6. For the commonly available strainer drains, the head portion 14 is placed over the strainer drain, such that the shaped aperture 16 engages the strainer drain lock nuts, and the handle 12 is used to rotate the strainer drain to either install or remove the strainer drain. Additionally, as depicted in FIG. 2, the edge piece 22 may be attached to the head portion 14 at a location on the head portion 14 opposite of the handle 12. In this implementation, the edge piece 22 engages the lock nut slots of drop-in shower drains, and the edge piece 22 may be rotated via the handle 12 to install or remove the drop-in shower drain.

Figure 4:
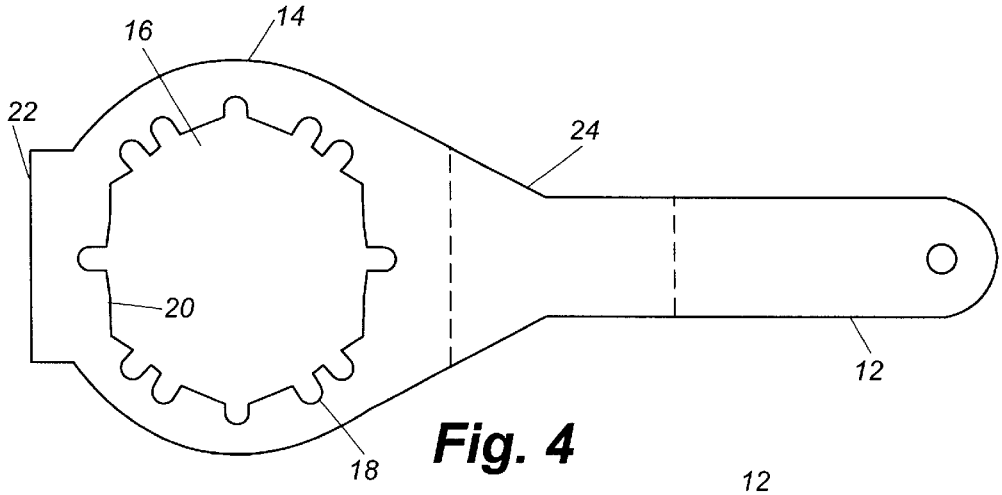
FIG. 4 is a top view of another embodiment of the present invention
Figure 5:
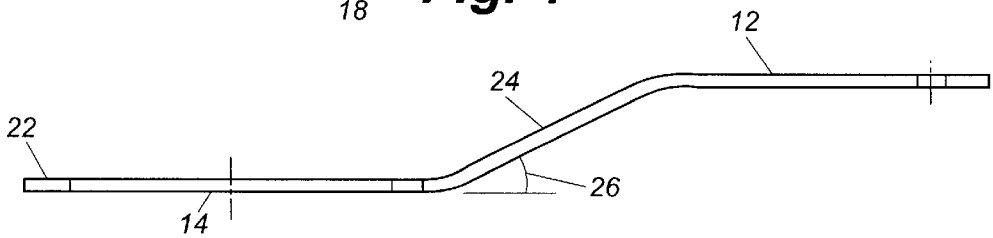
FIG. 5 is a side view of the embodiment depicted in FIG. 4.

FIG. 4 shows an alternative embodiment of the present invention, wherein the rotating means is a fixed handle 12 offset at an angle 26 from the head portion 14. In the embodiment depicted in FIG. 4, the handle 12 is permanently affixed to the head portion 14 with a throat portion 24 interposed between the head portion 14 and handle 12. FIG. 5 is a side view of the embodiment of the present invention depicted in FIG. 4. FIG. 5 shows the offset handle 12, wherein the throat portion 24 forms an angle 26 with the head portion 14, such that the handle 12 is offset from the head portion 14. This enables the drain tool 10 to be used more efficiently and more easily. The angle 26 may vary in different embodiments, such as from 0 degrees elevation from the head portion 14 to 70 degrees elevation from the head portion 14.

Figure 7:
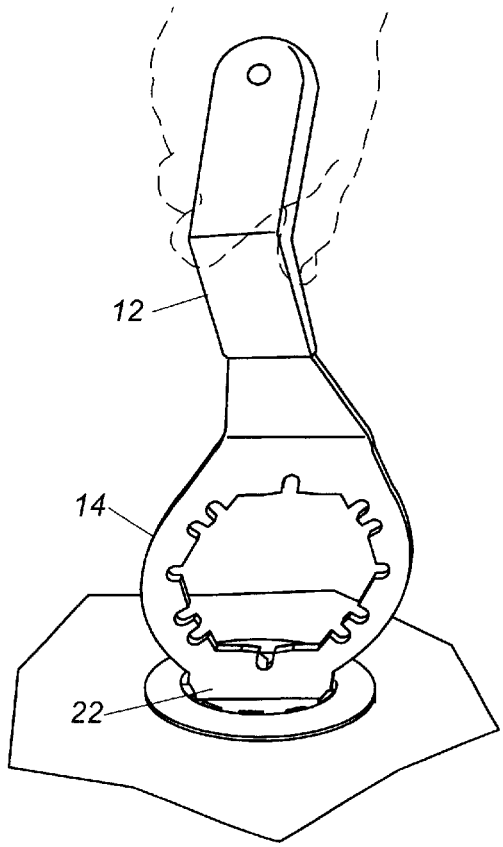
FIG. 7 is an embodiment of the present invention engaged with an example drop-in shower drain.

FIG. 6 shows one implementation of the present invention engaged with a strainer drain containing tab style locking nuts. As depicted in FIG. 6, the head portion 14 fits over the strainer drain, such that the shaped aperture 16 engages the locking nuts on the strainer drain. As further depicted in FIG. 6, the tab slots 18 engage the tab style locking nuts on the drain such that the head portion 14, when rotated by the handle 12, may remove or install the drain FIG. 7 depicts an embodiment of the present invention engaged with a drop-in shower drain. As depicted in FIG. 7, the edge piece 22 may be inserted into the internal lock nut slots of a drop-in shower drain. When the edge piece 22 is engaged with the lock nut slots, the head portion 14 may be rotated by the handle 12 such that the drop-in shower drain may be removed or installed. In an alternative embodiment, the edge piece 22 may be located on a side of the head part 14, such that when the edge piece 22 is engaged with the lock nut slots, the handle 12 forms an approximately 90 degree angle with the drop in shower drain (not shown).

It should be emphasized that the above described embodiments of the present invention, particularly, any preferred embodiments, are merely possible examples of implementations, set forth for a clear understanding of the principles of the invention. Many variations and modifications may be made to the above described embodiment(s) of the invention without departing substantially from the spirit and principles of the invention. All such modifications and variations are intended to be included herein within the scope of this disclosure and the present invention and protected by the following claims.

I claim:

1. A drain tool for use with multiple drains, a first of the drains including a tabbed lock nut, a second of the drains having a hex shaped lock nut, the drain tool comprising:

a head portion having a shaped aperture, the shaped aperture comprising a substantially hexagonal opening wherein an edge of the substantially hexagonal opening contains a plurality of tab openings configured to engage the tab lock nut of the first drain, the substantially hexagonal opening of the shaped aperture being dimensioned to engage the hex shaped lock nut of the second drain; and means for rotating the head portion such that, when the plurality of tab openings of the shaped aperture of the head portion engages with the tabbed lock nut of the first drain, the tabbed lock nut may be tightened or loosened by the head portion, and, when the shaped aperture of the head portion engages with the hex shaped lock nut of the second drain, the hex shaped lock nut may be tightened or loosened by the head portion.

2. The drain tool of claim 1, wherein the plurality of tab openings are configured to engage a four-tab lock nut.

3. The drain tool of claim 2, wherein the plurality of tab openings are further configured to engage a six-tab lock nut.

4. The drain tool of claim 3, wherein the plurality of tab openings are further configured to engage an eight-tab lock nut.

5. The drain tool of claim 1, further comprising an edge portion attached to the head portion and extending outwardly therefrom in a substantially rectilinear shape, the edge portion being configured to engage a third drain, the third drain including an internal lock nut having a lock nut slot such that the substantially rectilinear shape of the edge portion engages the lock nut slot of the third drain.

6. The drain tool of claim 5, wherein the edge portion is located on the head portion opposite from the means for rotating the head portion.

7. The drain tool of drain 1, wherein the means for rotating the head portion is an elongated handle engaged with the head portion such that a user may grasp the handle and rotate the head portion.

8. The drain tool of claim 7, wherein the handle is permanently affixed to the head portion.

9. The drain tool of claim 8, wherein the handle is offset at an angle from the head portion.

10. A drain tool for use with multiple drains, a first of the drains including a tabbed lock nut, a second of the drains having a hex shaped lock nut, the drain tool comprising:

a head part having an aperture, the aperture comprising a substantially hexagonal opening wherein an edge of the substantially hexagonal opening contains a plurality of tab openings configured to engage the tab lock nut of the first drain, the substantially hexagonal opening of the aperture being dimensioned to engage the hex shaped lock nut of the second drain; and a handle part affixed to the head part such that the head pant may be rotated by the handle part when the plurality of tab openings of the aperture of the head part engage the tabbed lock nut of the first drain, thereby rotating the tabbed lock nut, and such that the head part may be rotated by the handle part when the aperture of the head part engage the hex shaped lock nut of the second drain, thereby rotating the hex shaped lock nut.

11. The drain tool of claim 10, wherein the handle part is offset at an angle from the head part.

12. The drain tool of claim 10, further comprising:

an edge part affixed to the head part and extending outwardly therefrom in a substantially rectilinear shape, the edge part being configured to engage a third drain, the third drain including an internal lock nut having at least one lock nut slot, such that the substantially rectilinear shape of the edge part engages the lock nut slot of the third drain.

13. The drain tool of claim 12, wherein the edge part is located at the opposite end of the head part from the handle part.

14. A drain tool for use with multiple drains, a first of the drains including a tabbed lock nut, a second of the drains having a hex shaped lock nut, a third of the drains including an internal lock nut having a lock nut slot, the drain tool comprising:

a substantially flat head piece having an aperture, the aperture comprising a substantially hexagonal opening wherein an edge of the substantially hexagonal opening contains a plurality of tab openings configured to engage the tab lock nut of the first drain, the substantially hexagonal opening of the aperture being dimensioned to engage the hex shaped lock nut of the second drain;

a substantially flat edge piece attached to the head piece and extending outwardly therefrom in a substantially rectilinear shape such that the edge piece engages the lock nut slot of the third drain; and a substantially flat handle piece attached to the head piece opposite from the edge piece such that, when the plurality of tab openings of the aperture of the head piece engage the tabbed lock nut of the first drain, the head piece may be rotated to rotate the tabbed lock nut, and such that, when the aperture of the head piece engages the hex shaped lock nut of the second drain, the head piece may be rotated to rotate the hex shaped lock nut, and such that, when the edge piece engages the lock nut slot of the third drain, the edge piece may be rotated to rotate the internal lock nut of the third drain.

15. A drain tool system, the system comprising:

a first drain, the first drain including a tabbed lock nut for securing the first drain to at least one of a sink or a shower;

a second drain, the second drain including a hexagonal lock nut for securing the second drain to at least one of a sink or a shower; and a drain tool, the drain tool comprising:

a head portion having a shaped aperture, the shaped aperture comprising a substantially hexagonal opening, the substantially hexagonal opening having six edges defining the perimeter of the shaped aperture, where the edges of the substantially hexagonal opening contain a plurality of tab openings, each of the plurality of tab openings extending outwardly form an edge of the shaped aperture in an inverted u-shape, where the plurality of tab openings are dimensioned and located along the perimeter of the shaped aperture such that the plurality of tab openings engage the tabbed lock nut of the first drain, the substantially hexagonal opening being dimensioned to engage the hexagonal lock nut of the second drain; and means for rotating the head portion such that, when the plurality of tab openings of the shaped aperture of the head portion are engaged with the tabbed lock nut of the first drain, the tabbed lock nut may be tightened or loosened by the head portion, and when the shaped aperture of the head portion engages with the hexagonal lock nut of the second drain, the hexagonal lock nut may be tightened or loosened by the head portion.

16. The drain tool system of claim 15, wherein the means for rotating the head portion is an elongated handle engaged with the head portion such that a user may grasp the handle and rotate the head portion.

17. The drain tool system of claim 16, wherein the handle is offset at an angle from the head portion.

18. The drain tool system of claim 17, wherein the system further comprises a third drain, the third drain including an internal lock nut for securing the third drain to at least one of a shower or a sink, the internal lock nut including a lock nut slot.

19. The drain tool system of claim 18, wherein the drain tool further comprises an edge portion extending outwardly from the head portion in a substantially rectilinear shape, the edge portion configured to engage the third drain such that the rectilinear shape of the edge portion engages the lock nut slot of the third drain.

* * * * *